US005350065A

United States Patent [19]

Darrey

[11] Patent Number: 5,350,065

[45] Date of Patent: Sep. 27, 1994

[54] TOOL AND HARDWARE CARRIER FOR BUCKET

[76] Inventor: John J. Darrey, 1799 Highland Ave., North, Apt. 134-J, Clearwater, Fla. 34615-2109

[21] Appl. No.: 76,436

[22] Filed: Jun. 11, 1993

[51] Int. Cl.[5] ..... B65D 85/20; B65D 6/40; A47F 7/00

[52] U.S. Cl. ..... 206/373; 211/70.6; 220/697; 220/700; 220/735

[58] Field of Search ..... 206/372, 373; 211/70.6; 220/23.83, 697, 699-702, 735

[56] References Cited

U.S. PATENT DOCUMENTS

| | | | |
|---|---|---|---|
| 2,446,016 | 7/1948 | Lessin | 211/70.6 X |
| 3,273,746 | 9/1966 | Andrews, Jr. | 220/699 X |
| 3,298,532 | 1/1967 | Wilcke | 211/70.6 |
| 4,826,007 | 5/1989 | Skeie | 206/373 |
| 4,867,332 | 9/1989 | Mains | 206/372 X |
| 4,911,295 | 3/1990 | Venegoni | 206/372 |
| 4,925,026 | 5/1990 | McKay | 206/373 |
| 4,947,998 | 8/1990 | Smeller | 211/70.6 |
| 5,092,463 | 3/1992 | Dees | 206/373 |

*Primary Examiner*—Bryon P. Gehman
*Attorney, Agent, or Firm*—Charles E. Lykes, Jr.

[57] ABSTRACT

An apparatus for carrying hand tools which comprises an adaptation for a bucket. The adaptation further comprises a bucket insert with a planar and circular top member to be positioned at or near and across the top of the bucket and a cylindrical cavity down through the center of the bucket. The circular top member is adapted with a series of holes and slots to receive tools and the cylindrical cavity is adapted to facilitate the maneuver of a person's hand. In an alternative embodiment, the insert may be permanently fixed to the bucket.

18 Claims, 2 Drawing Sheets

TOOL AND HARDWARE CARRIER FOR BUCKET

FIELD OF THE INVENTION

The invention relates to tool storage and carrying devices, particularly those used with respect to small hand tools.

BACKGROUND OF THE INVENTION

It is useful for a worker to have a variety of small hand tools to have at his or her disposal. This is true when performing carpentry functions or when doing simple mechanical jobs such as vehicle maintenance or the repair of small electrical appliances or appurtenances. In such cases, a variety of small tools should to be immediately at disposal. Additionally, in the course of performing such work, a worker is usually required to temporarily remove small nuts, bolts, and screws and to be able to recover such items quickly and easily. Additionally, it is helpful to have a variety of other supplies, such as gloves, measures, finishing and other nails, or any number of other small items immediately available.

A variety of prior art devices have has made efforts at solving this problem. They range from simple ideas to some rather large and complex appurtenances. For instance, U.S. Pat. No. 4,826,007 issued to Skeie, on May 2, 1989, comprises a bucket-like device which is adapted with a large compartmentalized base member and a generally circular and planar ring about its top. The generally planar and circular ring about its top is further adapted with slots and holes to hold tools and with a bulky cover. The top planar member extends about the outside circumference of the top of the bucket and tool handles may protrude up through the inner portions of this upper circle. The device taught in Skeie is obviously cumbersome but does accomplish the function of permitting the simple and quick storage and mobility of a variety of hand tools.

U.S. Pat. No. 5,174,447 issued to Fleming on Dec. 29, 1992 teaches a bucket with a belt of pockets around the inner circumference of the bucket and the outer circumference of the bucket. The handles or shafts of various tools can be fit within these pockets, which are essentially draped about the top of the bucket. Some of these pockets are adapted with bottom and top closing devices (such as pocket flaps) to permit small implements to be held therein without danger of falling out. Because the wire bale of the bucket handle provides one of the bases of support of the pocket apparatus, it is necessary to remove the wire bale in order to install the apparatus taught in Fleming.

U.S. Pat. No. 4,765,472, issued to Dent, on Aug. 23, 1988 is another version of a tool holder similar to Fleming utilizing the same principle. Neither of these invention s teaches a separate storage area for nuts and bolts. Each of them relies on the wire bale to support the tool-holding apparatus. Each of these additionally requires fastening a flexible belt or rectangular tool carrier about the bucket.

Another style of tool holder is taught U.S. Pat. No. 5,186,329, issued to Fogelberg on Feb. 16, 1993. This apparatus teaches a set of partitions which may be used to divide the interior of the bucket into compartments of various sizes and shapes. An interesting novation of Fogelberg is its use of an apparently semi-rigid and spiraling compartment dividing arrangement to permit its adaptation with a range of bucket sizes and taper patterns, which may narrow from the bucket tops to bucket bottoms. The device taught in Fogelberg, while helpful, does not provide very easy access to the bottoms of any of the compartments and compartments do not lend themselves to simple identification of the tools therein.

Yet another general style of tool holder is taught by U.S. Pat. No. 4,362,243 issued to Deyesso, et al on Dec. 7, 1982, and U.S. Pat. No. 5,092,463, issued to Dees on Mar. 3, 1992. Each of these patents teaches a generally circular and planar surface which is adapted to fit within the top of a bucket-type carrier in order to hold tools. The device taught by Dees was designed for use with larger tools, such as are used for gardening and landscaping functions such as hose, spades, rakes, and brooms. The Dees device teaches the use of large and supported holes within said circular planar surface and the use of brackets with wing nuts supports to hold and fasten the circular planar surface near the top of the tub.

Deyesso teaches what amounts to a flanged ring which is adapted with holes within the width of the ring and which will fit about a point near the top of a bucket by simply finding its point of equilibrium as it moves down the depth of the bucket. The flanged member is adapted with holes and slots which may be used to support the handles of tools. In an alternative variation to the device, a circular member, with no flanged ring, is adapted with notches about its outer circumference through which the tool handles may be positioned. Neither Deyesso nor Dees teaches any separate section for small implements to be loosely held such as the nuts, bolts and screws.

What is not provided in the prior art is an apparatus which is useful in facilitating the simple and easy storage of such hand tools, easily moving them from one place to another, additionally storing small items which may also be useful in performing carpentry and mechanical operations, and finally accounting for such tools at the end of a period of work.

SUMMARY OF THE INVENTION

The present invention solves the problems remaining from the prior art by providing a simple bucket-like apparatus which is adapted to perform each of these functions. An insert for a bucket is provided which comprises a generally planar and circular top member, which further comprises a flanged ring such that its outer circumference fits about the upper circumference of the bucket and an inner cylindrical member which connects the inner annular ring diameter with the bottom of the bucket, forming a cylindrical cavity along the center axis of the bucket. This cylindrical cavity is large enough for a person's hand to easily fit within to reach small implements. About the upper surface annular ring, a series of slots and holes are provided which are adapted to permit the simple and easy insertion or removal of a variety of hand tools. These slots and holes may be adapted or labeled for specific tools or combination of tools.

For instance, screwdrivers, chisels, punches, and other tools may be positioned with their operable ends and shafts down through the holes and within the cavity created between the cylindrical middle section and the bucket wall. The larger holes may be adapted to permit larger tools such as a hammer, to be positioned therein by inserting the handle and shaft end down into the hole so that the hammer head protrudes up above the annular ring. Slots could also be positioned across this annular ring so as to permit saw blades to be inserted therein, or other flat tools such as chisels or planing surfaces.

As the inner cylinder will be large enough to permit a person's hand to fit easily within, it would be a simple task to place nuts, bolts, or screws in this area. They then can be reached and retrieved without significant difficulty and will automatically be moved from one work location to the other. This should save considerable time and stress during the performance of routine carpentry and mechanical functions.

It is then, an object of the present invention to provide a simple tool carrier which permits the storage of a variety of hand tools and further permits other useful implements during the conduct of simple carpentry and mechanical functions.

It is a further object of the present invention to provide such an implement which further permits easy access to such additional items.

It is a further object of the present invention to provide a tool carrier such as that described above which further facilitates the simple accountability and inventory of various hand tools at a work site.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

Figure 1:
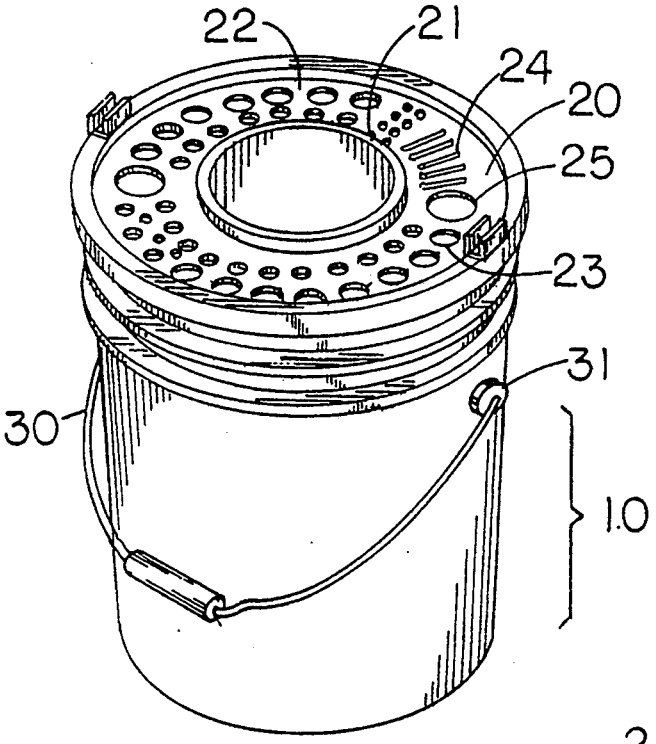
FIG. 1 is an oblique view of the present invention showing each of the major features.

Making reference first to FIG. 1, it can be seen that the apparatus includes a standard bucket (10), a tool insert annular ring (20) and bucket handle (30). The tool insert annular ring (20) further comprises an inner cylinder (21) and an upper surface (22).

Figure 2:
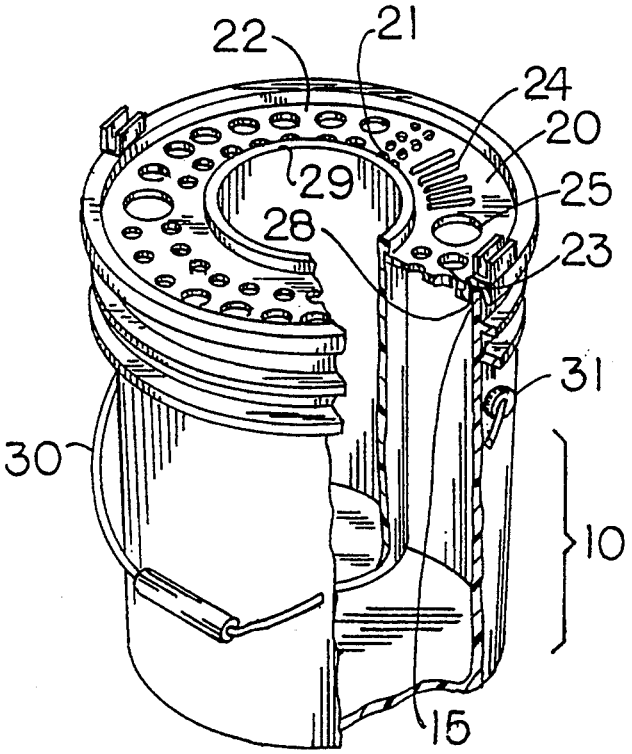
FIG. 2 is another oblique view in which a portion is cut out to enable viewing of a vertical cross section of the subject invention further showing the relationship between the tool insert and bucket portions.

Briefly making reference to FIG. 2, it can be seen that the bucket wall (11), the bucket floor (13), the upper surface of the tool insert annular ring (20), and the inner cylinder wall (50), define a generally rectangular open space, when viewed as a cross section, and that this open space surrounds the inner cylinder (21).

Figure 6:
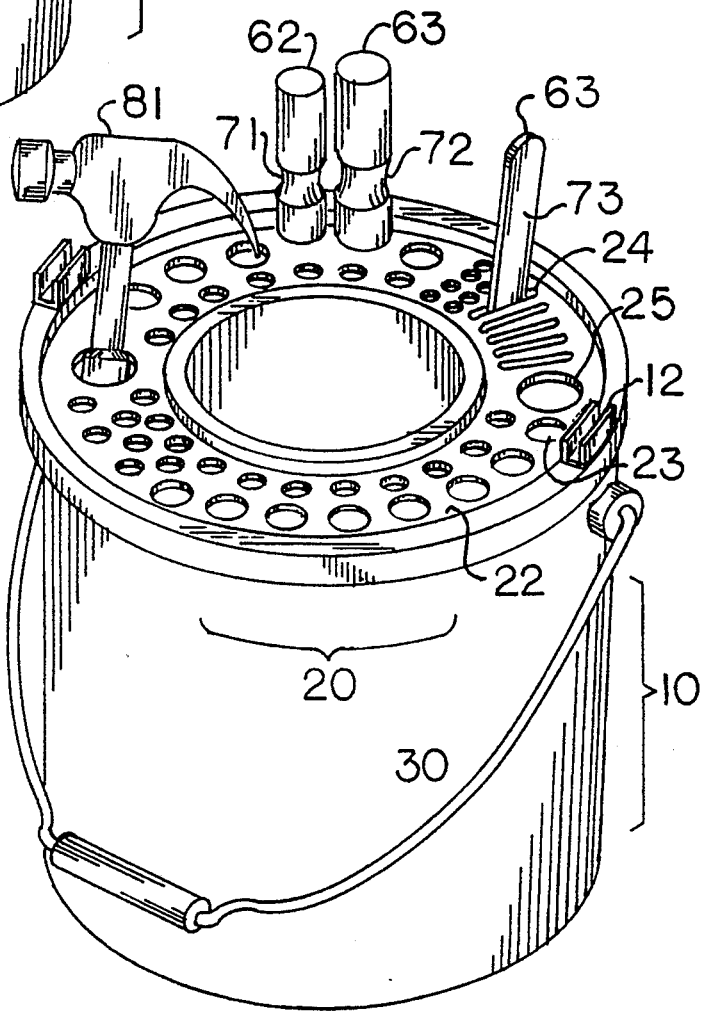
FIG. 6 depicts the apparatus within which some tools are stored.

Making reference again to FIG. 1, it can be seen that the upper surface (22) is adapted with a series of openings (23, 24, 25). These openings comprise various sizes of circles (23, 25) and tool slots (24). Such circles (23, 25) and tool slots (24) are adopted to permit either the operating shaft of a hand tool (61, 62, 63), as depicted in FIG. 6, (such as a screwdriver, chisel, punch, or other hand tool) to be thrust into and through said hole (23, 25) or tool slot (24) and the handle (71, 72, 73) of said tool rest upon the upper surface (22). With respect to the larger holes (25), it may be possible to thrust the handle of a larger tool such as a hammer (81) through said larger holes (25) for storage. The slots (24) may be used, in a similar fashion, accept the blade of a saw (83) or the flat surface of a file or planing tool (not depicted) for storage, allowing the handle to protrude therefrom.

As described in FIGS. 1, 2, 4, and 6 the annular ring (20) lower side is adapted with a slot (28) on its lower side (29) which runs about the circumference of the annular ring (20). This slot, as shown, receives the upper edge or ridge (15) of the bucket (10) and rests securely thereon. It is pointed out here that there may be alternative ways of allowing the annular ring (20) to be held upon the bucket, any of which may be in accord with the spirit and scope of this invention.

Figure 7A:
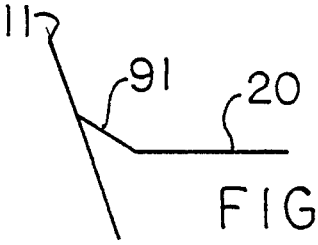
FIGS. 7A and 7B depict upper and lower sloping flanges which may be used to keep bucket and insert in place, respectively.
Figure 7B:
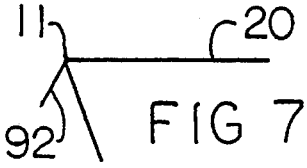

For instance, as depicted in FIG. 7A, the outer circumference (93) could be adapted with a flange (91, 92) which slopes up or down from the annular ring (20) to either nestle within or settle around the upper edge or ridge of the bucket (11) respectively. Such additional means are not depicted. Accordingly, the description of the preferred embodiment in association with such a configuration is only meant to describe one means of accomplishing such task and not to limit the scope of the invention.

In this manner, the configuration described above provides a container and storage area for various hand tools that a carpenter or mechanic may need to move about quickly from one place to another. Such container is as simple to move from one place to another as a bucket.

The inner cylindrical space (21) may be used in a variety of manners. Such inner cylindrical space (21) is an easy and convenient place to put loose articles such as nuts, bolts, screws, or nails. It would also accommodate measuring devices, such as tape measures, or other irregularly shaped objects such as a leveling device. Markers could also be placed within this area. Additionally, simply to save time, tools from the slots and circles could be temporarily stored in this area in an upright position to facilitate quickly discarding one tool and grabbing another without taking the time to search for the precise or assigned hole or slot for a given tool. At the end of the day, the tools could be returned to their appropriate receptacle to facilitate inventory or accountability.

Figure 5:
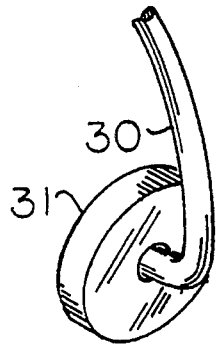
FIG. 5 depicts the attachment of the bucket bail to the bucket side.

It is clear from observing either FIG. 1 or FIG. 2 that the bucket handle (30) rests within a swivel device (31) (as depicted in FIG. 5) permitting it to rotate from one side of the bucket, into an upright position, or to the other side of the bucket. When it is considered that, from time to time, tools will not be evenly stored about the upper surface (22) or, even when all tools are properly placed, there may be a weight imbalance across the upper surface (22). This would result in a tendency on the part of the bucket (10) to not hang straight and be more difficult to carry and place.

Figure 3A:
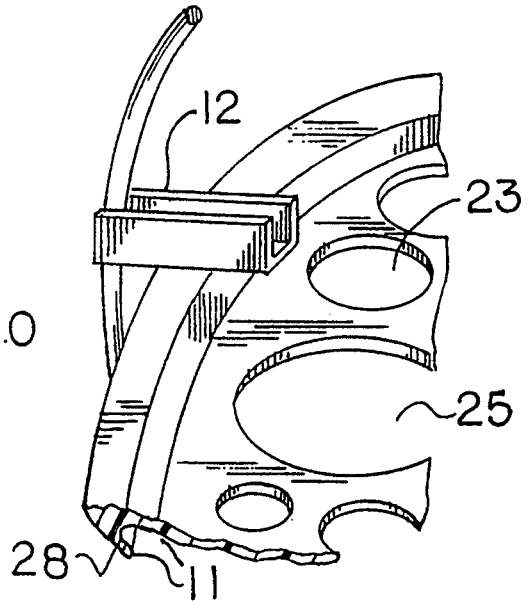
FIGS. 3A and 3B are close-up views of the handle-stabilizing apparatus in the locking and unlocking positions, respectively.
Figure 3B:
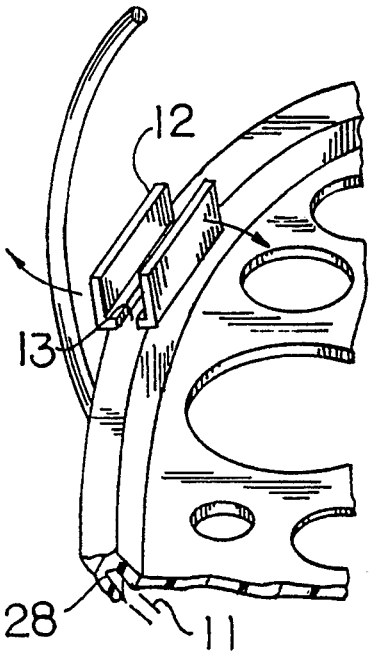
Figure 4:
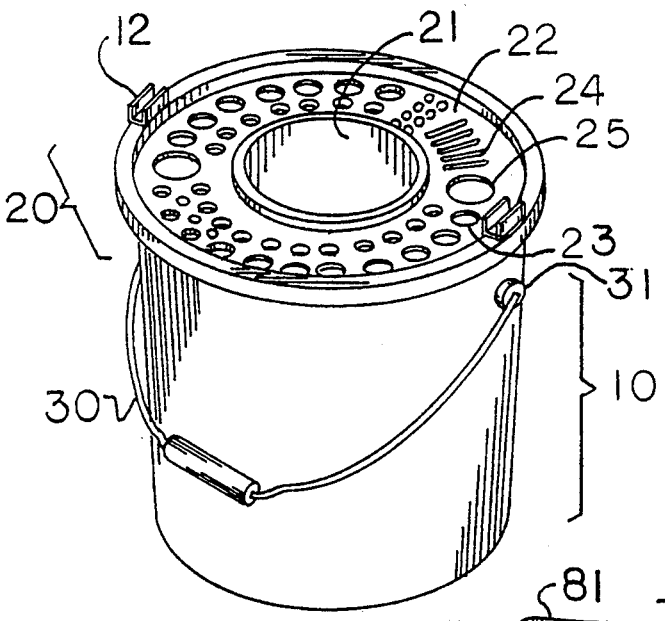
FIG. 4 depicts an alternative embodiment of the apparatus without the stabilizing ridges about the upper circumference of the bucket.

In order to prevent this from interfering with the use if the apparatus, the upper ridge (11) of the bucket (10) can be adapted with a pair of swivel locking devices (12). Such are depicted in FIGS. 3A and 3B. In FIG. 3A the swivel locking device (12) is depicted swiveled such that it does not interfere with the motion of the bucket handle (30) as it rotates from one side of the bucket (10) to the other. Also making reference to FIG. 3A, it can be seen that one end of the swivel device (12) is adapted with a slot (13).

Now making reference to FIG. 3B, it can be seen that the swivel locking device (12) can be swiveled about so that it is generally perpendicular with the upper ridge (11) of the bucket (10). The locking device slot (13) is directed outward from the bucket (10). In the manner, the bucket handle (30) can fit within this slot and be held in an upright position. This facilitates keeping the bucket (10) properly oriented for carrying and placing, even when the load within the tool carrier is not even displaced.

Reference is again made to FIG. 1, specifically to the slots (24) and holes (23, 25) in the upper surface (22) of the annular ring. It may be advisable to, from time to time, prepare certain specific patterns of holes (23, 25) and tool slots (24). These holes (23, 25) and tool slots (24) may be tailored to fit certain specific combinations of tools (such as a carpentry set as opposed to a mechanical set) or the slots and holes may be labeled. The patterns may be selected to help facilitate and even balance by counter-weighting the heavier tools against the heavier tools and the lighter tools against the lighter tools, or may be otherwise organized to facilitate more orderly work.

After a reasonable period of familiarity, a worker will be able to use the holes (23, 25) and tool slots (24) to quickly inventory and ascertain specifically which tools are missing and which tools may be required for replacement in order to accomplish specific tasks. The inner cylindrical cavity (21) is well adapted to carry extra tools which may be needed for specific applications.

It should further be pointed out that the apparatus as described herein may be manufactured or distributed in different ways. For instance, a kit comprising both the bucket member and the insert could be sold together. Nothing would preclude the insert from being removable from the bucket so that, when necessary, the worker could use the bucket without the insert. Additionally, the insert could be sold by itself. However, it can be seen that the insert would necessarily have to match a given bucket, at least with respect to minimum depth requirements and precise circumference of the upper bucket end. There is no reason why a variety of inserts could not be manufactured to match certain standard bucket sizes and shapes.

It should also be pointed out that the apparatus as herein described may be either rigid, or semi-rigid, or even more flexible than what may normally be thought of as semi-rigid. Accordingly, the apparatus as taught herein could be made with a variety of plastic or metals or a combination of plastic and metal. For instance, the bucket could be made of metal and the insert plastic, or vice versa. Additionally, it should be noted that FIGS. 1 and 2 depict the use of a bucket of which the top portion is reinforced by ridges (27) about its circumference near the top. Such ridges may be necessary to provide adequate shape stability to thinner metals or plastics. The use of such ridges are optional according to the amount of strength required and the bucket material used. With the use of materials or reinforcement which provides sufficient strength, as many as 75 such hand tools may be stored in such an apparatus.

It further should be mentioned that the bucket and insert may either be made integrally or they could be joined permanently. In either of these cases the "insert" would then amount to a permanent fixture and the bucket would be useful only as a tool carrier. This could be accomplished by molding plastic, welding, or fastening with fasteners such as nuts and bolts. The variety of ways in which such components could be joined or fastened is well-known and not meant to be the subject of this invention, except as described. The principles of the present invention are equally applicable to any such method of joining or fastening.

Modification and variation can be made to the disclosed embodiments without departing from the subject and spirit of the invention as defined in the following claims. Such modifications and variations, as included within the scope of these claims, are meant to be considered part of the invention as described.

What is claimed is:

1. An insert apparatus for adapting a bucket for use in carrying tools and otherwise facilitating the conduct of tasks with hand tools, the insert apparatus comprising;

a circular member which is generally planar and further comprises a generally circular opening at its center, said circular member being constructed of a noncorrosive material and of adequate strength to bear the weight of a plurality of tools customarily held in and controlled by hand and moved from place to place during the conduct of mechanical, carpentry, plumbing, or electrical functions;

said circular member further comprising holding means for holding tools said holding means for holding tools further comprising receiving means about its circumference on a bottom side, said receiving means adapted to receive the upper ridge of a bucket of matching circumference and having an open interior, such that said circular member generally forms a plane across the top of said bucket with said circular opening at or near the bucket's center;

said circular member being further adapted with a series of openings at various points across its surface, said openings comprising a series of slots and holes in a variety of sizes and shapes which may correspond with various hand tools such that a given hand tool will rest securely in one of said openings;

said circular opening being joined with an upper end of a cylindrical member, said cylindrical member being open at said upper end and extending down to a generally planar and closed lower end such that objects may be placed within the cylindrical cavity formed between the upper and lower ends, said circular opening being of adequate size to permit a person's hand to fit and maneuver within said cylindrical cavity.

2. The insert apparatus described in claim 1 in which said holding means further comprises a slot on the lower side of said circular member at its outer circumference which is adapted to receive the upper ridge of a bucket.

3. The insert apparatus described in claim 2 in which said circular member is provided on its upper side at points opposite one another and proximate to its outer circumference with pivoting blocks, said pivoting blocks mounted upon said circular member so as to rotate about a pivot point in a plane generally parallel with said circular member and each being further provided with a line slot of sufficient width to receive the bail of a bucket handle such that said line slots may be rotated out beyond the circumference of an upper bucket edge and receive said bucket handle when said bucket is in the upright, carrying position.

4. The insert apparatus described in claim 1 in which said circular member is provided on its upper side at points opposite one another and proximate to its outer circumference with pivoting blocks, said pivoting blocks mounted upon said circular member so as to rotate about a pivot point in a plane generally parallel with said circular member and each being further provided with a line slot of sufficient width to receive the bail of bucket handle such that said line slots may be rotated out beyond the circumference of an upper bucket edge and receive said bucket handle when said bucket handle is in the upright, carrying position.

5. The insert apparatus described in claim 4 in which said series of slots and holes are customized for a specific set of hand tools.

6. The insert apparatus described in claim 4 in which said series of slots and holes are customized for a specific set of hand tools and are labeled to facilitate the exact placement of said hand tools.

7. The insert apparatus described in claim 1 in which said series of slots and holes are customized for a specific set of tools.

8. The insert apparatus described in claim 1 in which said series of slots and holes are customized for a specific set of hand tools and are labeled to facilitate the exact placement of said hand tools.

9. The insert apparatus described in claim 1 in which said holding means further comprises a sloping flange member which slopes up from the outer circumference of said circular member so that said circular member can nestle within a bucket.

10. The insert apparatus described in claim 1 in which said holding means further comprises a sloping flange member which slopes up from the other circumference of said circular member.

11. A bucket and apparatus adapted for use in carrying tools and otherwise facilitating the conduct of tasks with hand tools, the apparatus comprising;

a circular member which is generally planar and is further adapted with a generally circular opening at its center, said circular member being constructed of a noncorrosive material and of adequate strength to bear the weight of a plurality of tools customarily held in and controlled by hand and moved from place to place during the conduct of mechanical, carpentry, plumbing, or electrical functions;

said circular member being fastened to the upper ridge of said bucket such that said circular member generally forms a plane across the top of said bucket with said circular opening at or near the bucket's center;

said circular member being further adapted with a series of openings at various points across its surface, said openings comprising a series of slots and holes in a variety of sizes and shapes which may correspond with various hand tools such that a given hand tool with reset securely in one of said openings;

said circular opening being joined with an upper end of a cylindrical member, said cylindrical member being open at said upper end and extending down into said bucket and further having a generally planar and closed lower end such that objects may be placed within the cylindrical cavity formed between the upper and lower ends, said circular opening being of adequate size to permit a person's hand to fit and maneuver within said cylindrical cavity, said cylindrical member being no longer than may fit into the bucket without preventing said circumferential slot with resting upon said upper bucket ridge.

12. The bucket and apparatus described in claim 11 in which said circular member is provided on its upper side at points opposite one another and proximate to its outer circumference with pivoting blocks, said pivoting blocks mounted upon said circular member so as to rotate about a pivot point in a plane generally parallel with said circular member and each being further provided with a line slot of sufficient width to receive the bail of a bucket handle used to carry said bucket such that said line slots may be rotated out beyond the circumference of the upper bucket edge and receive said bucket handle when said bucket handle is in the upright, carrying position.

13. The bucket and apparatus described in claim 12 comprising one or more reinforcing ridges about the outer circumference of said bucket near its upper end and the use of a thickened or dense material for said upper circular member to facilitate bearing sufficient weight for numerous hand tools.

14. The bucket and apparatus described in claim 13 in which said series of slots and holes are customized for a specific set of hand tools.

15. The bucket and apparatus described in claim 13 in which said series of slots and holes are customized for a specific set of hand tools and are labeled to facilitate the exact placement of said hand tools.

16. The bucket and apparatus described in claim 11 comprising one or more reinforcing ridges about the outer circumference of said bucket near its upper end and the use of a thickened or dense material for said upper circular member to facilitate bearing sufficient weight for numerous hand tools.

17. The bucket and apparatus described in claim 11 in which said series of slots and holes are customized for a specific set of hand tools.

18. The bucket and apparatus described in claim 11 in which said series of slots and holes are customized for a specific set of hand tools and are labeled to facilitate the exact placement of said hand tools.

* * * * *